US005555938A

United States Patent [19]

Tzeng

[11] Patent Number: 5,555,938

[45] Date of Patent: Sep. 17, 1996

[54] PICTURE-COMBINED FIRE EXTINGUISHER

[76] Inventor: Bae C. Tzeng, No. 67-4, Sec. 3, Jong Shan Road, Jong Her City, Taipei, Taiwan

[21] Appl. No.: 354,255

[22] Filed: Dec. 12, 1994

[51] Int. Cl.[6] ..... A62C 19/00

[52] U.S. Cl. ..... 169/36; 169/26; 169/52; 40/542; 40/714; 40/725; 40/776

[58] Field of Search ..... 169/26, 30, 36, 169/51, 52, 58; 40/152, 159, 542, 700, 714, 725, 733, 776

[56] References Cited

U.S. PATENT DOCUMENTS 1,932,291 10/1933 Prefontaine ..... 169/36
2,003,300 6/1935 Meigs ..... 169/36
4,223,739 9/1980 Waters ..... 169/52

*Primary Examiner*—Andrew C. Pike
*Attorney, Agent, or Firm*—Morton J. Rosenberg; David I. Klein

[57] ABSTRACT

A picture-combined fire extinguisher is characterized by a glass-shelled extinguisher having a frame, to which a show window is pivotally connected. The show window consists of a clear panel, and an outer frame which extends backward and inward to form a space allowing a picture to be inserted therein behind the panel. Luminous and protective pads are provided at corners of the frame of the extinguisher so that the extinguisher may be easily and timely identified and accessed even in a dark place or in the nighttime without lighting. Meanwhile, the picture-combined fire extinguisher functions not only as a fire extinguisher but also as an aesthetic article.

3 Claims, 4 Drawing Sheets

PICTURE-COMBINED FIRE EXTINGUISHER

BACKGROUND OF THE INVENTION

Most people do not know or know only little about the operation of a common fire extinguisher, and therefore, a fire extinguisher might very possibly lose its intended function due to improper handling of it even though it is duly provided. To eliminate the inconvenience in use of a conventional fire extinguisher, there is an extinguisher specially designed so that it can be easily used without needing to know any particular handling practice; a user may simply pick up the extinguisher and throw it toward and into fire, the extinguishing agent in the extinguisher spills over the fire and causes the same to be extinguished when the shell, which is usually made of glass, of the extinguisher is broken. Since such glass-shelled fire extinguisher is equivalent to the conventionally used fire extinguisher, in its fire extinguishing function while it is easy to use, it has been gradually adopted by the public.

Such glass-shelled fire extinguisher is usually hung on walls at an easily accessible location, or is positioned in a wall-mounted holder, such as that shown in FIG. 4. It can be seen that the existence of such a wall-mounted fire extinguisher is a somewhat inharmonious scene, when contrasted with surrounding furnishings. As a worse condition, such a structure might have the reverse influence on the willingness of people to have such fire extinguishers positioned indoors together with other furnishings, as they may spoil the integral interior decor which has now become one important part of peoples living environment.

Moreover, either a conventional fire extinguisher or a glass-shelled extinguisher on a holder is monotonous in design and therefore cannot be easily identified or accessed at night when a power failure occurs or in a fire when people are in panic. As a worse consequence, a fire may not be stopped quickly at an early stage due to such shortcomings in design of conventional fire extinguishers.

SUMMARY OF THE INVENTION

The primary object of the present invention is to provide a picture-configured fire extinguisher which has a frame provided at its periphery, allowing a show window to pivotally connect to the front of the free. A picture may be inserted into a space provided by the show window so that the fire extinguisher looks like a beautiful picture hanging on the wall and can be easily accessed when necessary.

Another object of the present invention is to provide the above mentioned fire extinguisher with luminous protective pads attached to four corners of the frame so that it can be clearly identified and timely accessed to stop a fire, even at night or a dark place when a power failure occurs.

BRIEF DESCRIPTION OF THE DRAWINGS

The objects and technique used to accomplish the present invention may be more clearly understood by referring to the following detailed description of a preferred embodiment thereof and the accompanying drawings in which.

DETAILED DESCRIPTION OF THE PREFERRED EMBODIMENTS

The present invention is characterized by its special structure that combines a fire extinguisher and a picture so that the fire extinguisher may be used as an aesthetic article in addition to its intended usage as a fire extinguisher.

Figure 1:
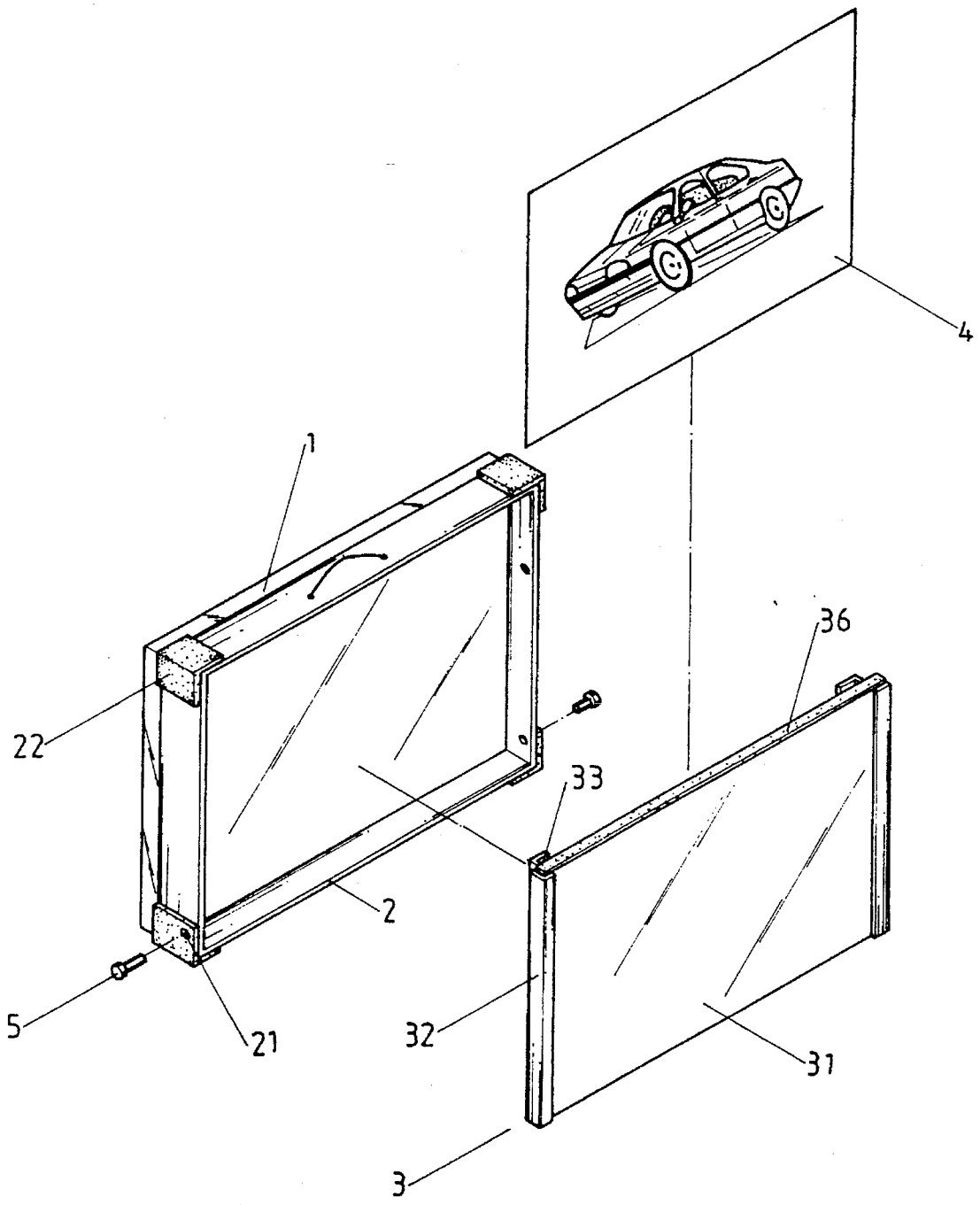
FIG. 1 is an analytical three-dimensional perspective view of an embodiment according to the present invention.

Please refer to FIG. 1, in which an embodiment according to the present invention is shown. The invention includes a retangularly-configured glass-shelled fire extinguisher 1 which is filled with a liquid extinguishing agent and closed. A metal or plastic frame 2 surrounds four edges of the extinguisher 1 in such a manner that its front slightly extends out from the front of the rectangular extinguisher 1 while its rear edges are located somewhere between the rear and the front edges of the extinguisher 1. That is, the rear portion of the extinguisher 1 is not surrounded and covered by the frame 2, and a show window 3 is pivotally connected to the front lower projected edge of the frame 2.

Figure 2:
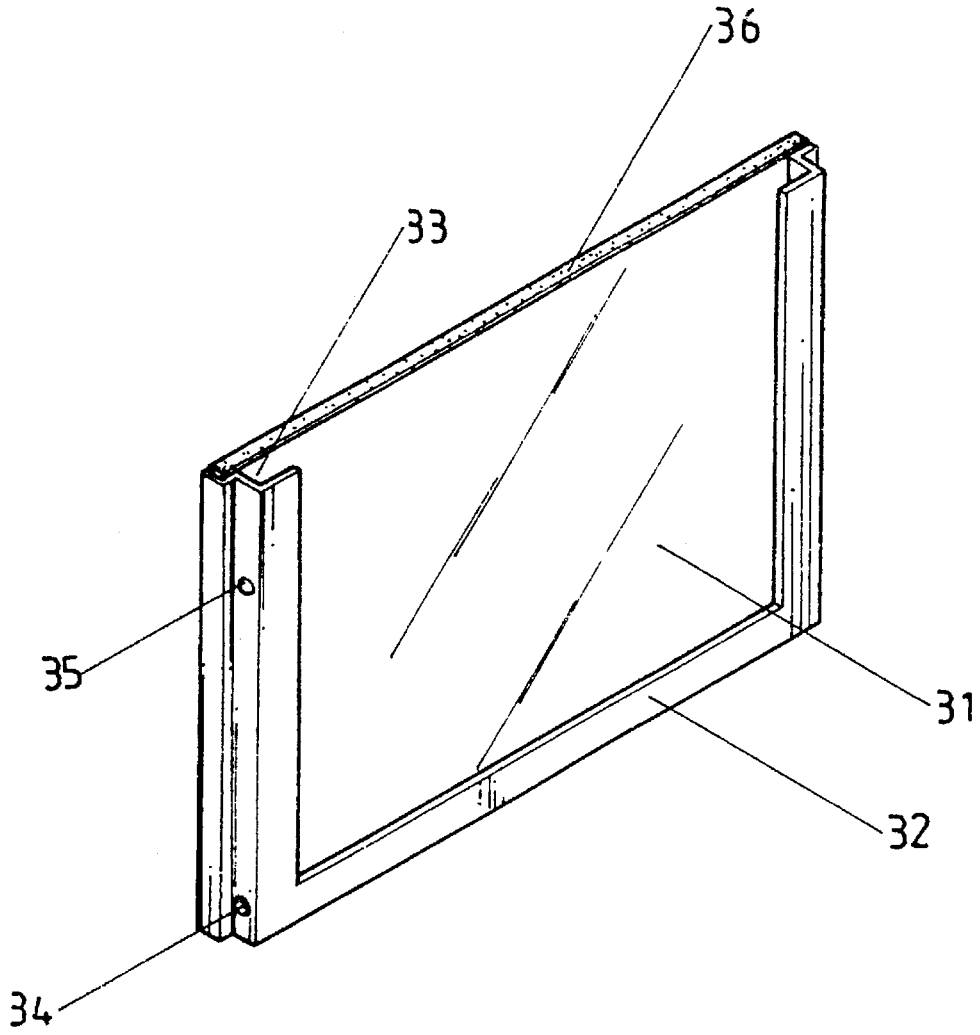
FIG. 2 is a rear perspective view of a show window to be attached to the extinguisher constituting the present invention.

The show window 3 mainly consists of a clear panel 31 with a metal or plastic outer frame 32 provided at its periphery. The outer frame 32 is so formed that it extends backward and inward to enclose the panel 31 and forms a space 33, as shown in FIG. 2, suitable for receiving a picture 4 and the like therein. Two holes 34 are separately provided at each side of the backward extended portion of the outer frame 32, separately corresponding to two pivot holes 21 separately provided at each side of the frame 2, for two pins or bolts 5 to thread through and thereby pivotally connect the outer frame 32 to the frame 2. Two protuberances 35 are provided at each side of the outer frame 32 at an upper position to frictionally contact the frame 2 and thereby locate the frame 32 at an inner side of the frame 2 when the outer frame 32 of the panel 31 is pushed toward and into the frame 2.

A substantially rubber or synthetic rubber-made member 36 is provided to cover the top edge of the panel 31 so as to prevent a user from being cut and injured when he or she is trying to touch and pull the panel 31. The panel 31 may be made of glass or clear plastic material.

Figure 3:
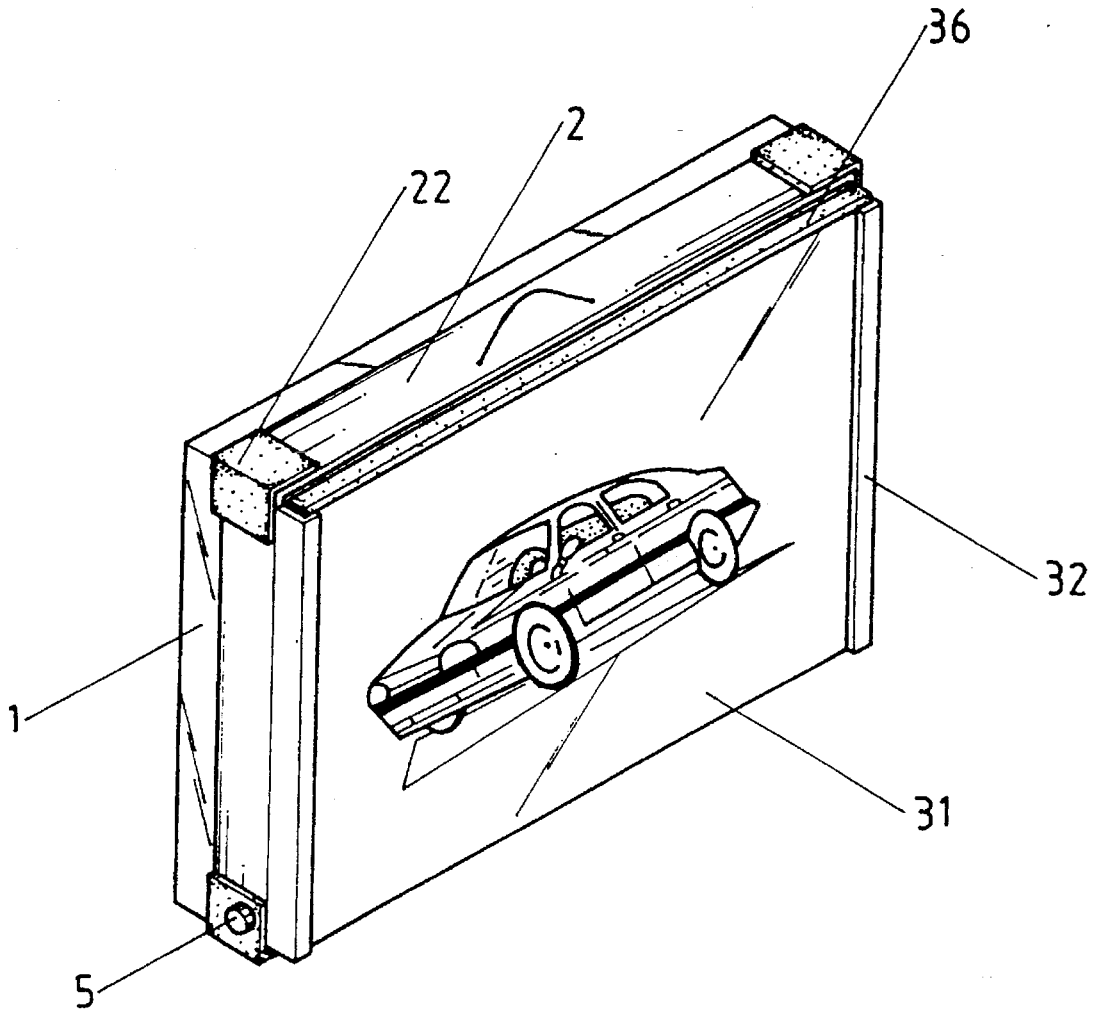
FIG. 3 is an assembled three-dimensional perspective view of the embodiment in FIG. 1.
Figure 4:
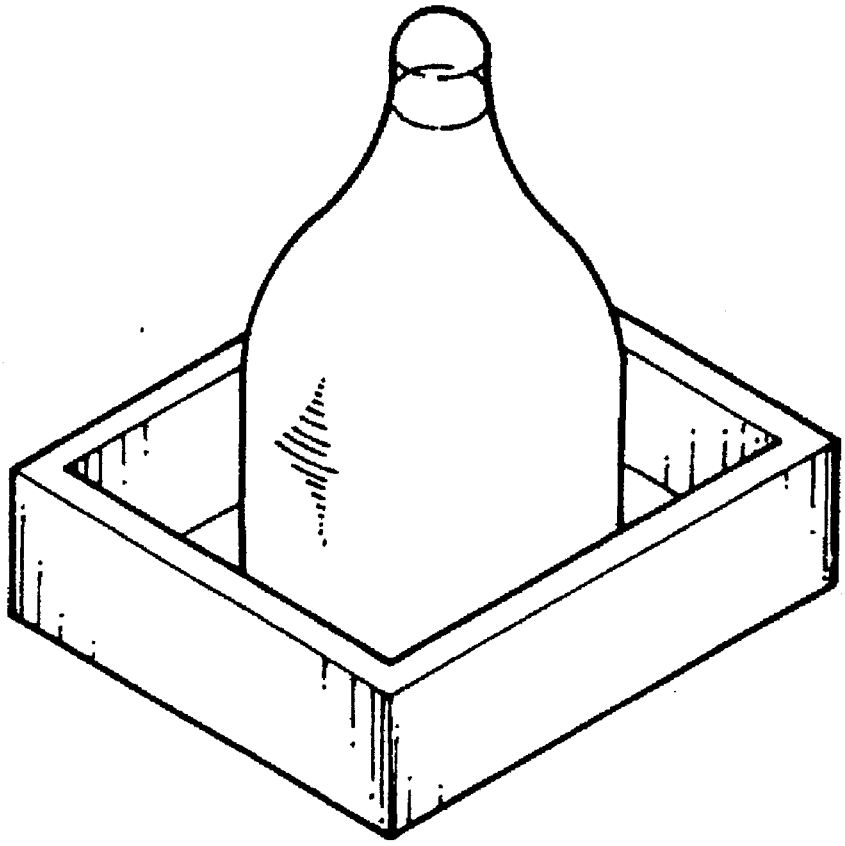
PRIOR ART FIG 4
FIG. 4 shows a conventional glass-shelled extinguisher in a holder.

Please further refer to FIG. 3 for the assemblage of the present invention. The pivot holes 21 on the frame 2 are aligned with the holes 34 on the outer frame 32 of the show window 3. Pins or bolts 5 are then put through the aligned holes 21, 34 and thereby pivotally connect .the show window 3 to the frame 2 just inside the frame 2, at the portion extending from the front of the extinguisher 1. To allow the outer frame 32 to have its left, right, and bottom edges aligned with the left, right, and bottom sides of the frame 2, respectively, after it is closed to the frame 2, the show window 3 has dimensions substantially the same as that of the frame 2. The top edge of the show window 3 is slightly higher than that of the frame 2 due to the existence of the rubber or synthetic rubber gasket member 36 to facilitate the pull or push of the panel 31 for inserting or taking out a picture 4.

Since the picture 4 is directly inserted into the space 33 provided by the outer frame 32 behind the panel 31, the only motion a user needs to place or replace a picture 4 in the show window 3 is to pull and then push the panel 31. The operation of the show window 3 is simple and convenient.

Luminous and protective pads 22 are adequately provided at, for example, four corners of the frame 2 so that the general configuration and position of the show window combined extinguisher 1 may be identified even in a dark place or at nighttime without lighting. In this way, the extinguisher 1 may be easily accessed or be prevented from being carelessly collided with.

According to the above description, the present invention is a fire extinguisher which, in addition to its intended usage to extinguish a fire, may be used as an indoor decorative article which gives the fire extinguisher an aesthetic and pleasant appearance that is completely different from the monotone appearance shown by most conventional fire extinguishers. Since pictures are suitable for handling in most houses and public buildings, picture-combined fire extinguishers may be more popularly accepted by users, due to their beautiful appearance and thereby provide the actual effect of added safety, protecting both life and property.

What is claimed is:

1. A picture-combined fire extinguisher comprising:

a glass-shelled fire extinguisher having a metal or plastic frame a front of which slightly extends beyond a front of said glass-shelled fire extinguisher; and a show window pivotally connected to said frame of said glass-shelled fire extinguisher and consisting of a clear panel with a metal or plastic outer frame that extends from a rear side thereof and extends inwardly to form a space suitable for receiving a picture therein behind said clear panel.

2. A picture-combined fire extinguisher as claimed in claim 1 wherein said outer frame of said show window has two holes separately formed near each lower corner of said outer frame corresponding to two holes separately formed at two sides of said frame of said glass-shelled fire extinguisher; and through said holes in said frame of said glass-shelled fire extinguisher and through said holes in said outer frame of said show window, pins or bolts are put so that said show window is pivotally connected to a lower portion of said glass-shelled fire extinguisher.

3. A picture-combined fire extinguisher as claimed in claim 1 wherein luminous and protective pads are provided at four corners of said frame of said glass-shelled fire extinguisher so that said glass-shelled fire extinguisher may be identified and easily accessed even in a dark place or in nighttime without lighting.

* * * * *